US011547203B2

(12) United States Patent
Jeung

(10) Patent No.: US 11,547,203 B2
(45) Date of Patent: Jan. 10, 2023

(54) CLEANING BRUSH ATTACHED TO ORAL IRRIGATOR

(71) Applicant: Young Girl Jeung, Daejeon (KR)

(72) Inventor: Young Girl Jeung, Daejeon (KR)

( * ) Notice: Subject to any disclaimer, the term of this patent is extended or adjusted under 35 U.S.C. 154(b) by 261 days.

(21) Appl. No.: 16/652,043

(22) PCT Filed: Sep. 27, 2018

(86) PCT No.: PCT/KR2018/011389

§ 371 (c)(1),
(2) Date: Mar. 28, 2020

(87) PCT Pub. No.: WO2019/066471

PCT Pub. Date: Apr. 4, 2019

(65) Prior Publication Data

US 2020/0245753 A1 Aug. 6, 2020

(30) Foreign Application Priority Data

Sep. 28, 2017 (KR) ..... 10-2017-0126223

(51) Int. Cl.
*A46B 11/06* (2006.01)
*A46B 11/00* (2006.01)
*A46B 5/04* (2006.01)

(52) U.S. Cl.
CPC ..... *A46B 11/063* (2013.01); *A46B 5/04* (2013.01); *A46B 11/0041* (2013.01); *A46B 2200/1026* (2013.01); *A46B 2200/1066* (2013.01)

(58) Field of Classification Search
CPC ..... A46B 11/00; A46B 11/003; A46B 11/001; A46B 11/0041; A46B 11/0072; A46B 11/06; A46B 11/063; A46B 5/04; A46B 5/02; A46B 2200/1026; A46B 2200/1066; A46B 2200/1086; A46B 2200/1073
(Continued)

(56) References Cited

U.S. PATENT DOCUMENTS 1,530,327 A * 3/1925 Redlick ..... A47L 13/19 D2/614
4,620,528 A * 11/1986 Arraval ..... A61H 13/00 401/268
4,903,864 A * 2/1990 Sirhan ..... A63H 37/00 2/160

FOREIGN PATENT DOCUMENTS

CN 2126793 A 2/1993
CN 1080149 A 1/1994
(Continued)

*Primary Examiner* — David J Walczak
(74) *Attorney, Agent, or Firm* — Maschoff Brennan

(57) ABSTRACT

A cleaning brush is attached to an oral irrigator that includes a supply pipe stored in a body unit, which has a control unit on the lower side of a cleaning tank in which a cleaning solution is stored, such that cleaning is carried out by supplying the cleaning solution at a predetermined water pressure. The cleaning brush includes a supply hole to which the supply pipe is connected and which is provided on the upper side of a finger cover having an insertion space into which a finger is inserted. Nozzles are formed at predetermined intervals on the upper side of a nozzle unit to which the supply hole is connected. A brush protrudes from the peripheral upper side at which the nozzles are formed. The supply hole has a connection member protruding outward and has a connector having connector-connecting pipes formed on both sides thereof.

5 Claims, 11 Drawing Sheets

(58) Field of Classification Search
USPC ..... 401/6–8, 289
See application file for complete search history.

(56) References Cited

FOREIGN PATENT DOCUMENTS

| | | | |
|---|---|---|---|
| CN | 2202436 | Y | 5/1995 |
| CN | 1269999 | A | 10/2000 |
| CN | 204368106 | A | 6/2015 |
| JP | 05-103559 | A | 4/1993 |
| JP | 11-113637 | A | 4/1999 |
| KR | 20-0239406 | Y1 | 10/2001 |
| KR | 10-1737903 | B1 | 5/2017 |
| KR | 10-1858615 | B1 | 6/2018 |

* cited by examiner

[FIG. 1]
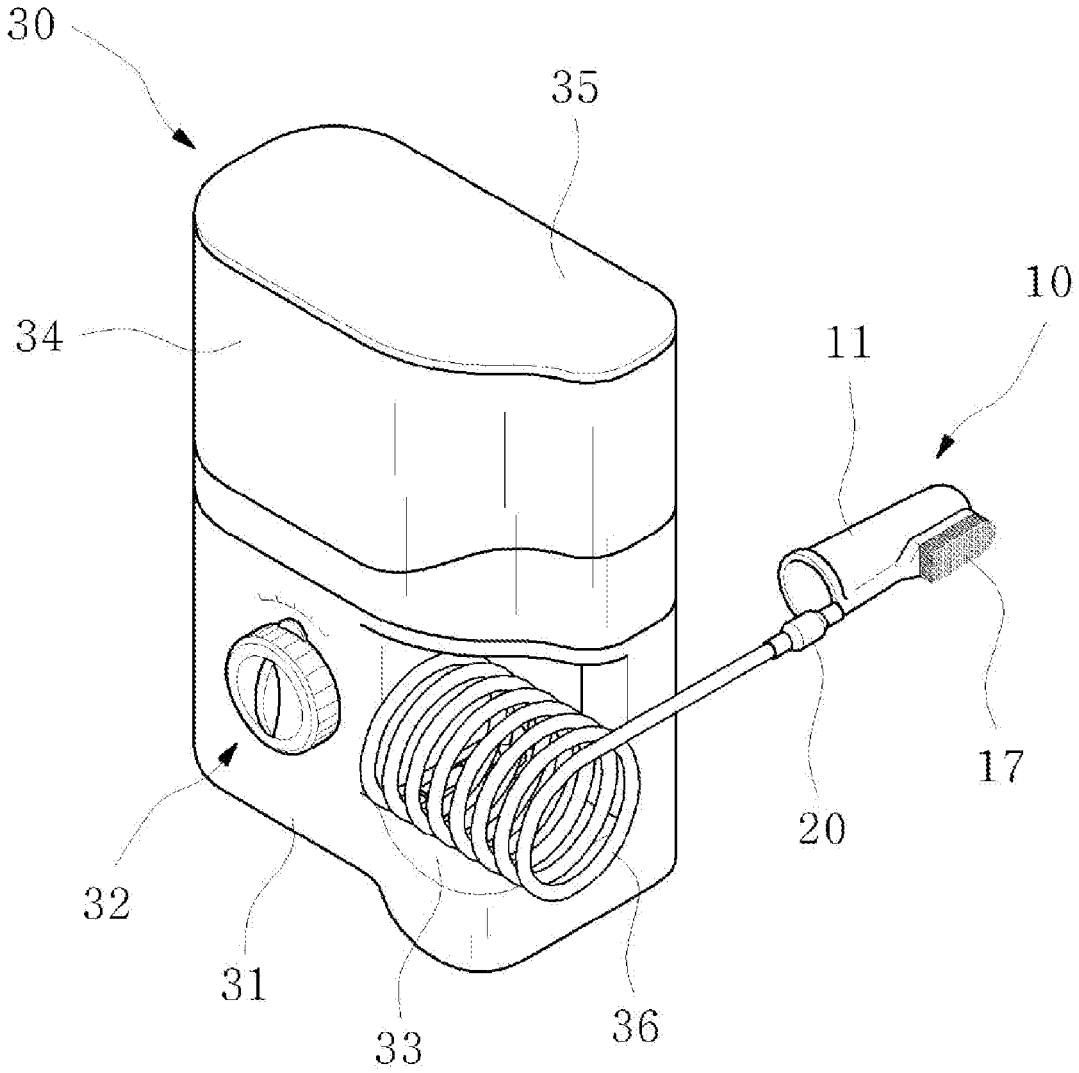

[FIG. 2]
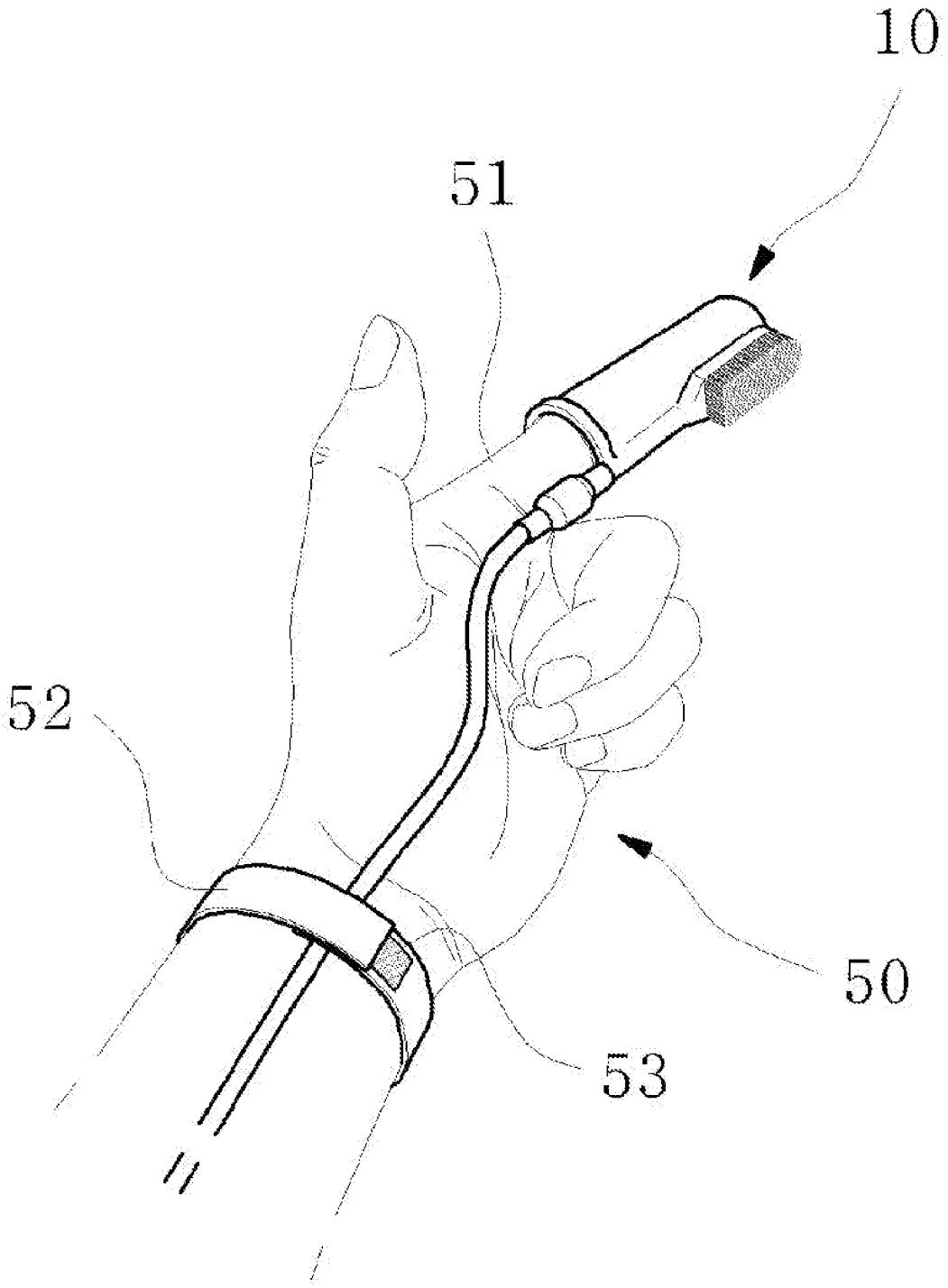

[FIG. 3]
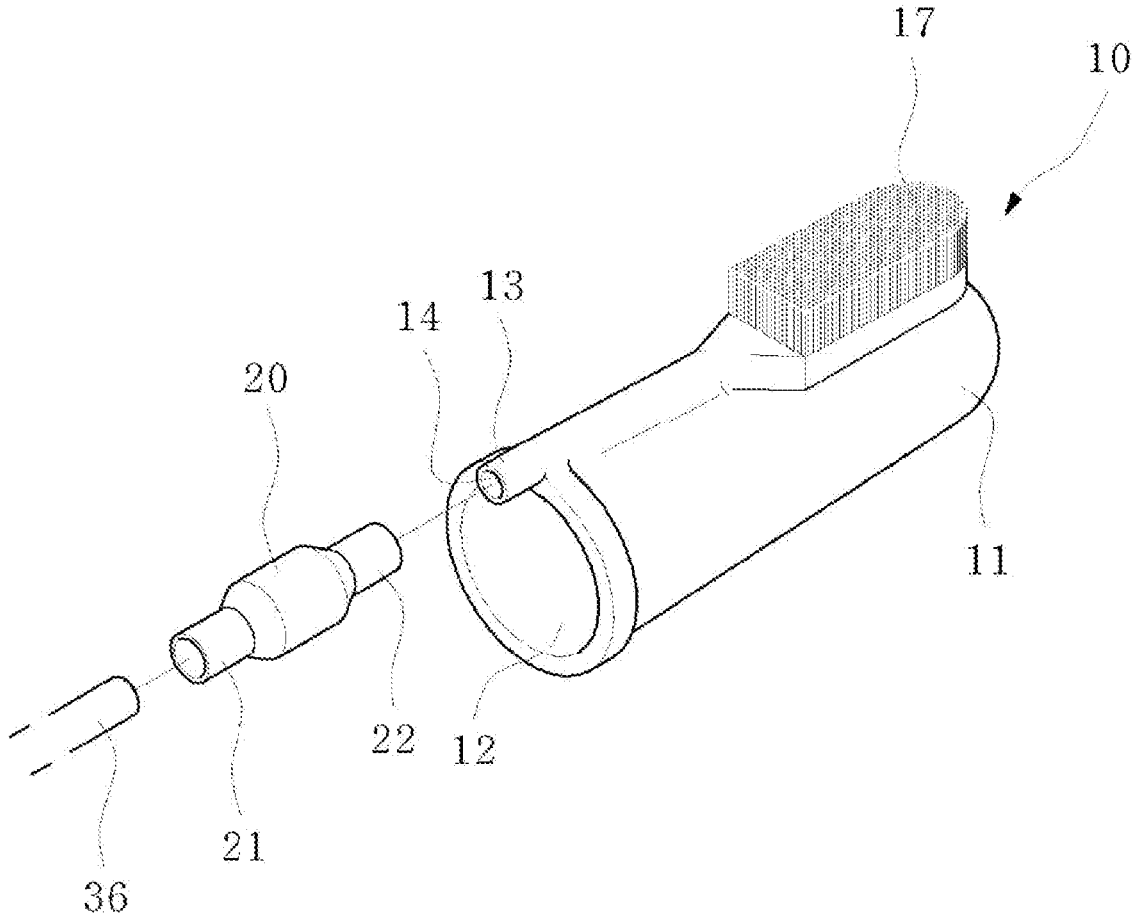

[FIG. 4]
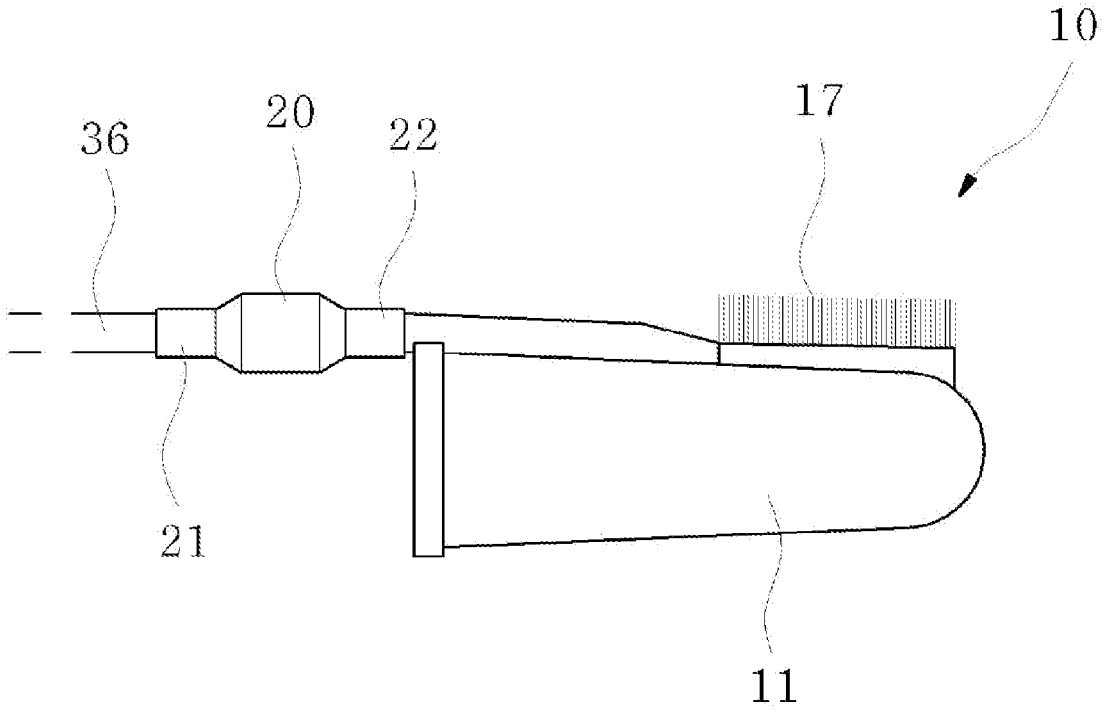

[FIG. 5]
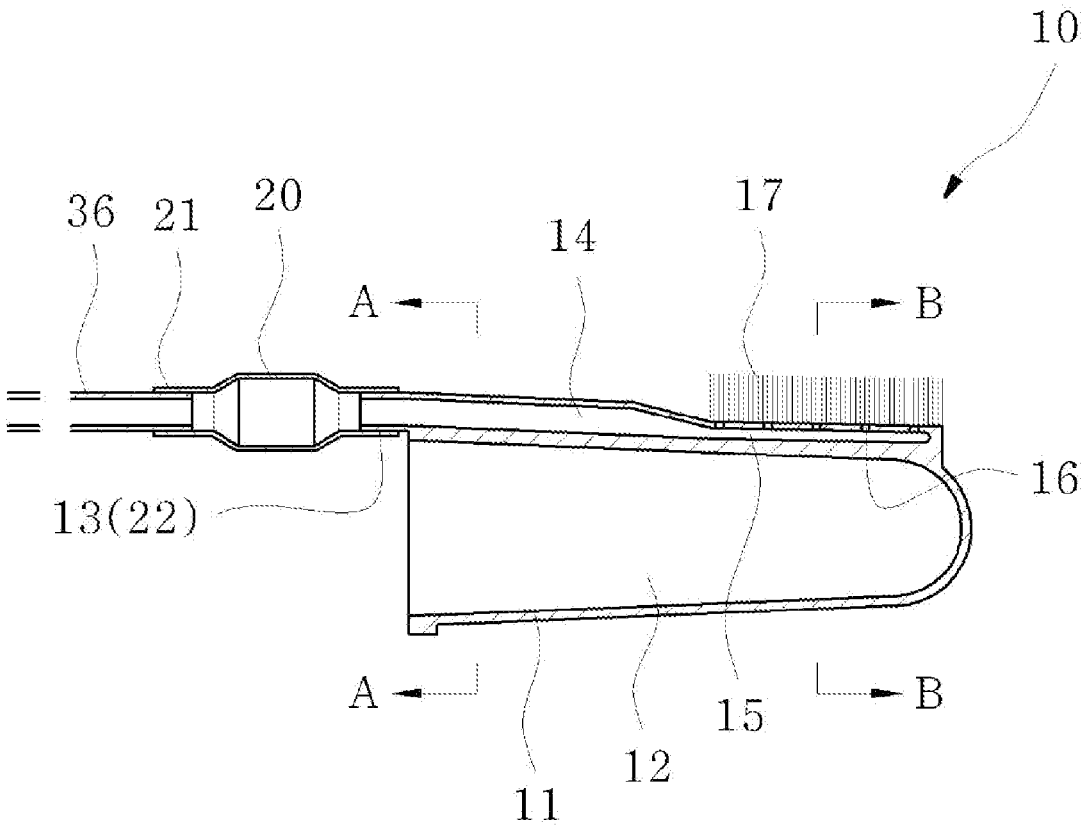

[FIG. 6]
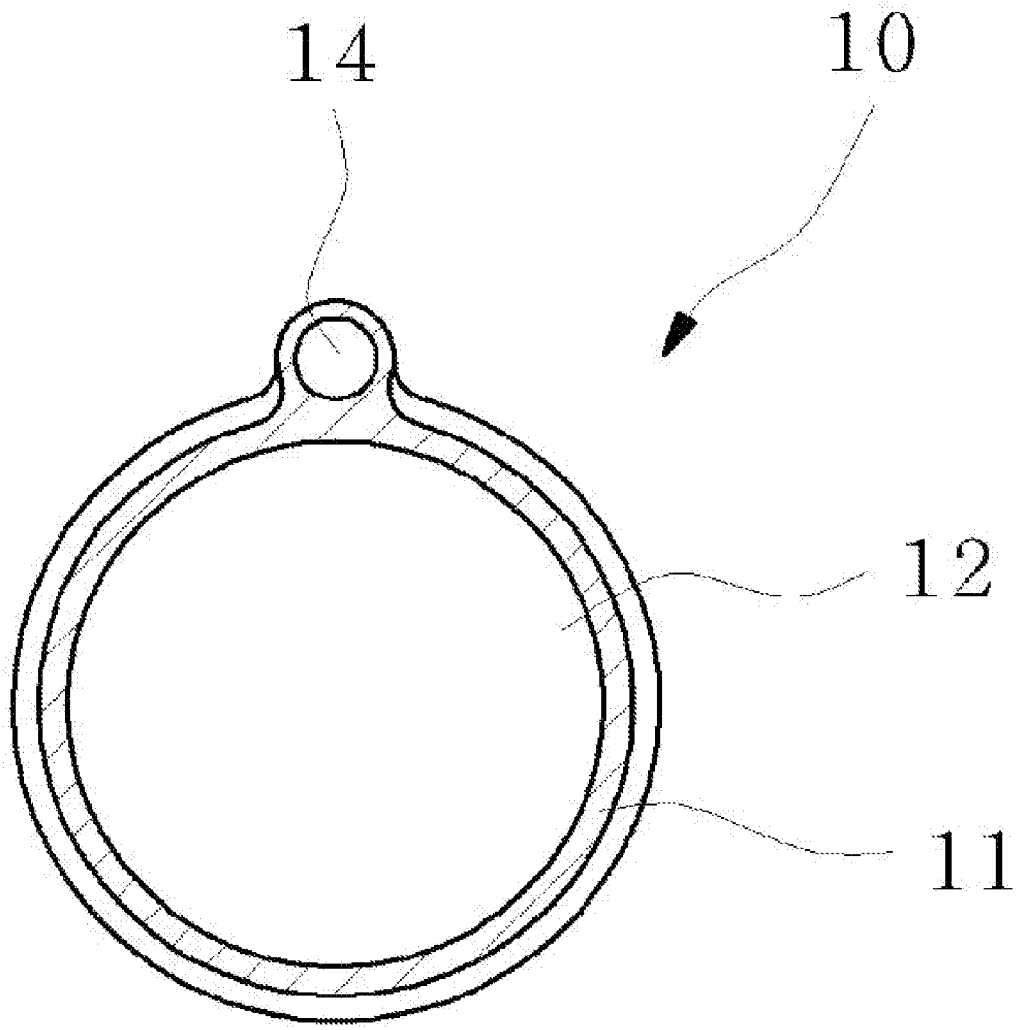

[FIG. 7]
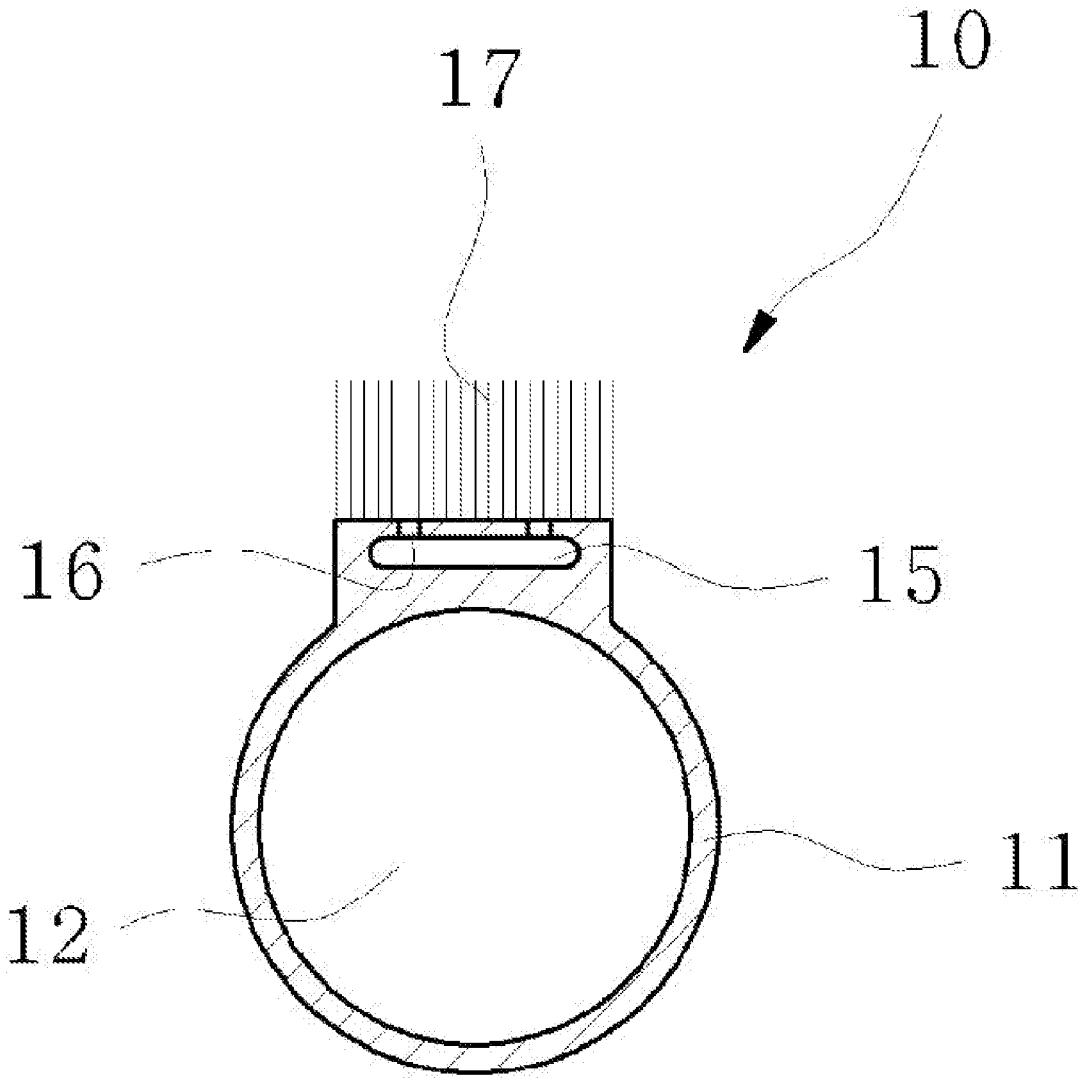

[FIG. 8]
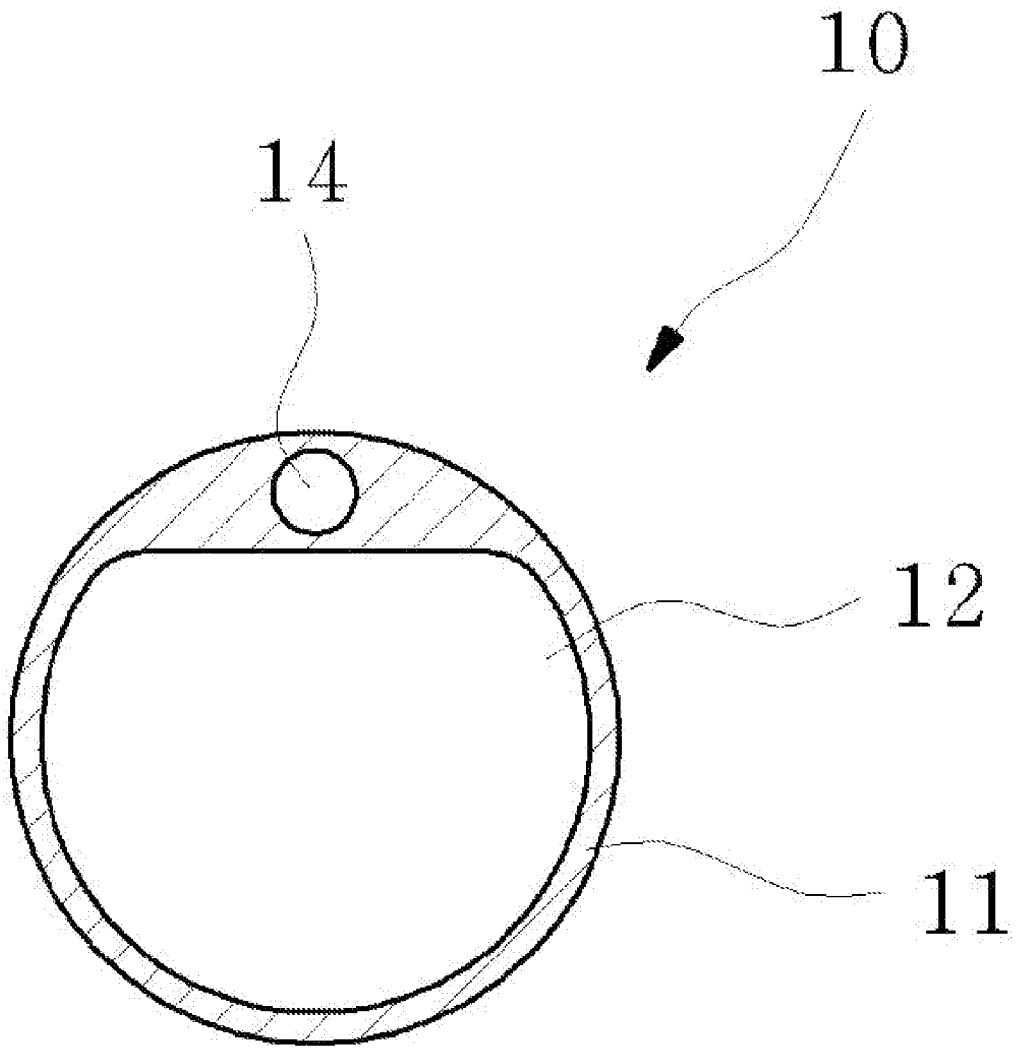

[FIG. 9]
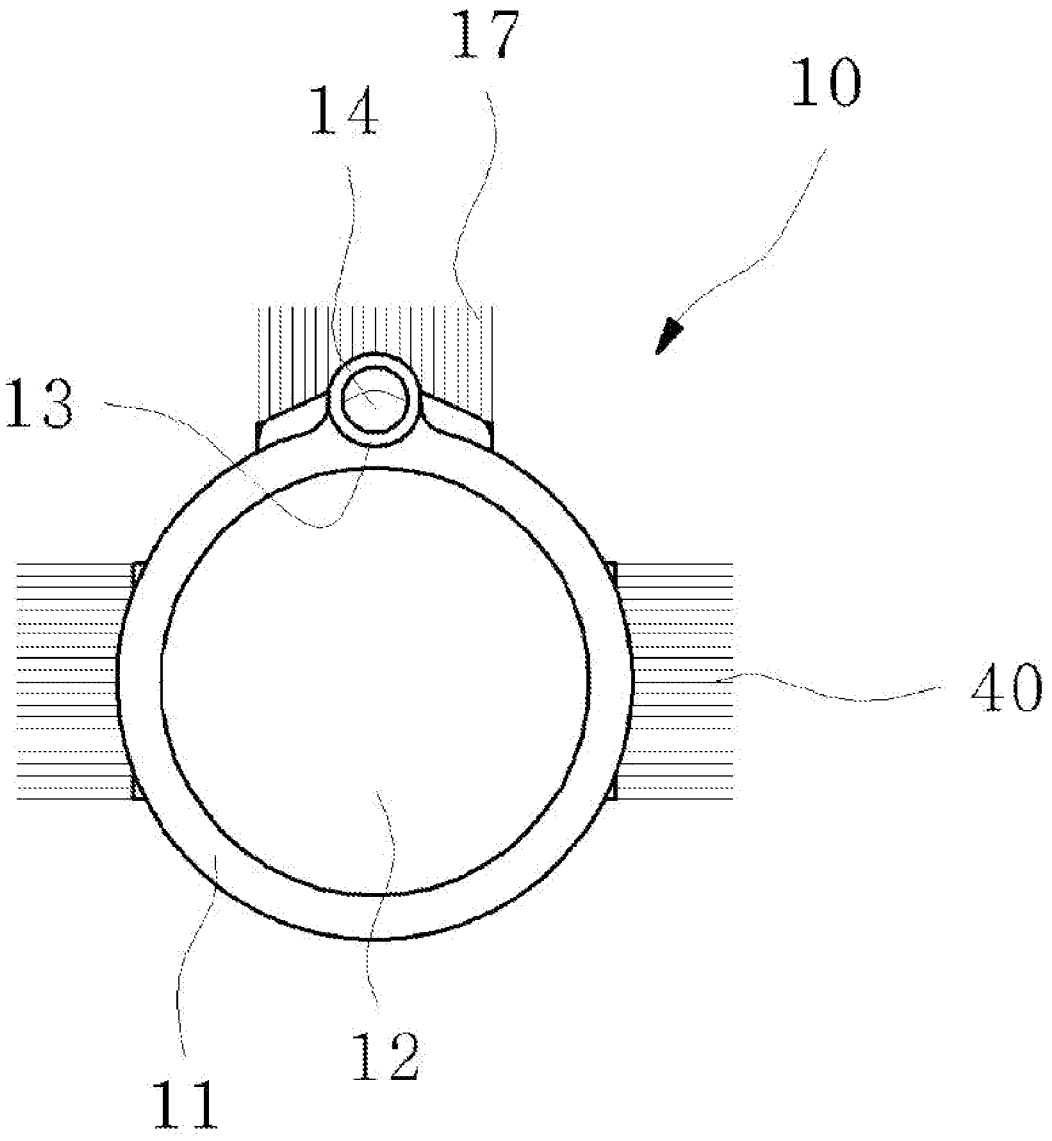

[FIG. 10]
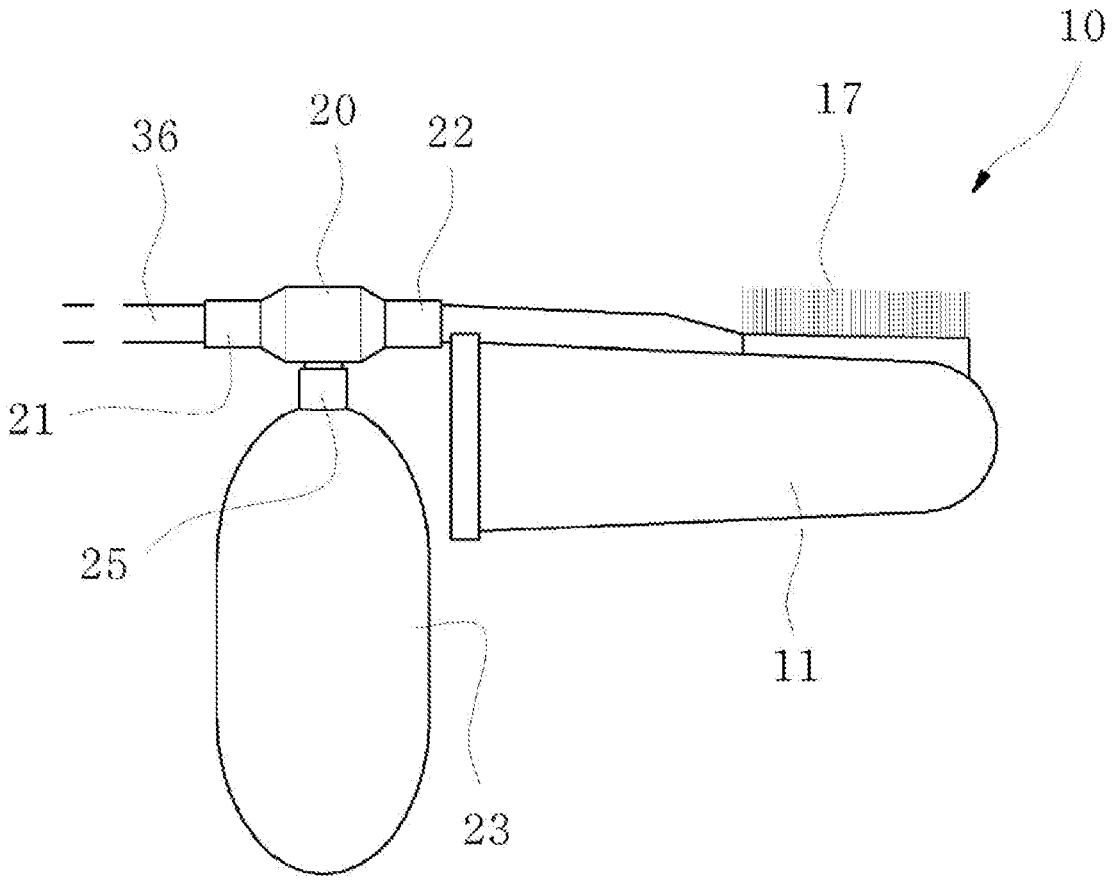

[FIG. 11]
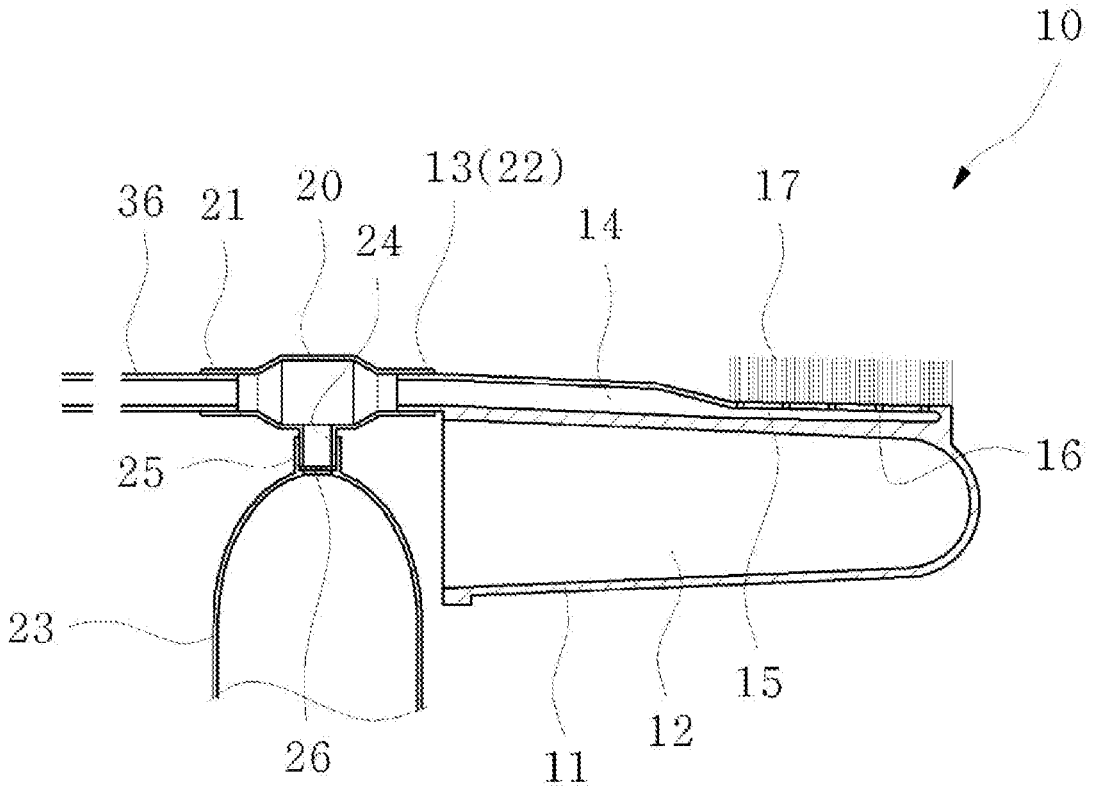

CLEANING BRUSH ATTACHED TO ORAL IRRIGATOR

TECHNICAL FIELD

The present invention relates to a cleaning brush attached to an oral irrigator, more particularly, to a cleaning brush attached to an oral cleaner to which an oral cleanser is fed at a predetermined water pressure and is sprayed toward the oral cavity of a pet, infant, patient, disabled person, etc., who have difficulty in managing oral cavities thereof, so as to remove dirt and bad breath of teeth while stimulating the teeth and gums to implement massage at the same time, thereby keeping the mouth of a pet, infant, patient, disabled person, etc., healthy and clean.

BACKGROUND ART

Dental caries (tooth decay) is one of the diseases that humankind has suffered from for a long time, but the incidence thereof is increasing due to the use of sugar, which is a daily sweetener. However, this disease substantially does not occur in animals living in their natural environment. On the contrary, the incidence of dental caries in pet is recently increasing due to preference for snack foods for humans that contain sugar or distribution of artificial feed.

Generally, tooth decay is an infectious disease accompanied by destruction of teeth, which is a multifactor-based disease caused by interaction of bacteria, food and saliva in dental plaque. Among bacteria in the dental plaque, *Streptococcus mutans* (*S. mutans*) is the main causative strain and induces dental caries through adhesion to the surface of a tooth ("tooth surface"), proliferation and acid generation. In other words, after adhering to the tooth surface, *S. mutans* generates insoluble glucan as a glucose polymer from the sucrose in the food by glucosyl transferase (Gtase). The insoluble glucan has been reported to substantially comprise $\alpha$-1,3 bonds. The synthesized glucan increases binding between bacteria that proliferate on the tooth surface, such *S. mutans* adhered to the tooth surface settles on the tooth surface and produces organic acid such as lactic acid during carbohydrate metabolism, thereby causing decalcification of tooth enamel and, finally, tooth decay.

*Dentalis lapis* may be the most common cause of periodontal disease while causing tooth decay. When inflammation is limited in the gum, that is, gingiva, the condition is gingivitis. Further, if the inflammation has already spread to a periodontal tissue, especially, to the alveolar bone during progression of gingivitis, the condition is determined as periodontitis. When the plaque is calcified, it becomes tartar which acts as a factor that further accelerates a fracture pattern. Further, bacterial plaque is the main cause of gingivitis, and chronic gingivitis may cause periodontitis.

On the other hand, animals, patients, disabled persons and infants cannot clean oral cavities and teeth by themselves to remove oral cavity residues due to eating and drinking.

In particular, in the case of the animal, the oral cavity and teeth are not only used for proper nutrition and taste or for breathing, but also for moving things, biting an object, licking things smeared on their bodies, etc. Therefore, behaviors more than those carried out by human hands may be done by the mouth and teeth.

Further, such behaviors are not confined to clean objects only, however, tasting, moving or licking unsanitary objects with harmful microorganisms may also cause illness.

Of course, animals cannot brush their own teeth and perform oral care and it is also not easy for persons to perform the same for the animal, and caretakers may dislike such work. Even if brushing teeth of the animal by any desired method, the animal may easily swallow toothpaste in the mouth instead of rinsing or spitting out the same.

For this reason, existing toothpastes for animals are typically composed of abrasives, softeners, sweeteners intended to neutralize the bitter taste, flavoring agents intended to neutralize halitosis and viscosity adjusters as a mixture. In this regard, a part of the plaque may be somewhat removed through the abrasive, but even the abrasive should be rinsed and thus is inconvenient to use every time for brushing. Further, the abrasive could not be continuously used since the animal dislikes the same, therefore, effects of the abrasive are not expected.

Moreover, there is a disadvantage wherein the existing animal toothpaste is not effective in removing harmful microorganisms, periodontitis, bad breath and plaque, and for oral hygiene of the animal.

In order to solve such problems, Korean Patent Registration No. 1737903 (pet mouth washer) has been proposed. According to this patent, high-pressure cleanser is sprayed into the oral cavity of the pet through the nozzle without being repulsed by the pet so as to simply and conveniently remove waste in teeth, tartar, bad breath, etc. of the pet while stimulating the teeth and the gums to massage the same, concurrently, so that the pet can be bred healthily. Further, the above mouth washer is provided with a protective part made of elastic material on an outer side of a nozzle member wherein the protective part is formed longer than the nozzle member, whereby the nozzle member to spray the high pressure cleanser does not directly contact the teeth of the pet and, therefore, the pet is not irritated or surprised while oral cleaning may be conducted quickly in a short time.

However, since the above device simply sprays the cleanser in the mouth through a common nozzle with water pressure, there is a problem of not perfectly cleaning the inside of the oral cavity during washing through a long and exposed nozzle stand.

Such disadvantages of the related art are also applicable to human beings such as infants, patients and disabled persons.

DISCLOSURE

Technical Problem

The present disclosure has been proposed to overcome the aforementioned problems, and an object of the present disclosure is to provide a cleaning brush attached to an oral cleaner that feeds a cleaning solution ("cleanser") at a predetermined water pressure, wherein waste in the oral cavity, tartar, bad breath, etc. may be eliminated while inserting a finger of a user and fixing the same to the cleaning brush; teeth and gums may be stimulated and massaged thereby keeping the mouth (that is, oral cavity) of pets, infants, patients and disabled persons healthy.

Another object of the present invention is to provide a cleaning brush wherein the index finger may be inserted into the brush, and a cleanser may be supplied with water pressure at a portion or desired portion where a soft material is exposed, thereby correctly and easily performing oral cleaning and oral care.

Technical Solution

According to the present invention, there is provided a cleaning brush, including: a cleaning tank for storage of a cleaning solution ("cleanser"); a body provided with a control unit below the cleaning tank; a feed duct accommodated in the body to feed the cleanser at a predetermined water pressure and clean the oral cavity; in addition, a feed hole, through which the feed duct is connected, formed on the upper side of a finger cover having a finger insertion space; nozzles provided at a predetermined interval above an exposed portion to which the feed hole is connected; and the brush protruding upward around nozzles, wherein the feed hole has a coupler protruding from an outer side of the hole, a connector having a connector joint formed on both sides thereof is provided so that the connector joint connects the feed duct and the coupler to supply the cleanser, wherein the connector is further provided with a lower coupler which is connected to a coupling protrusion formed on top of a concentrated cleanser feeder, and a backflow preventing member is installed in the coupling protrusion such that the concentrated cleanser is fed through another finger not connected to the cleaning brush.

Advantageous Effects

The present invention has such functional effects that a cleanser is supplied at a high pressure through an oral cleaner without any sense of discomfort to a pet, infant, patient, disabled person or the like who has difficulty in oral administration by themselves; waste in the oral cavity, plaque, bad breath, etc. can be directly, conveniently and cleanly removed while inserting and fixing a finger of the user to the cleaning brush; and the teeth and gums may be stimulated along with massaging, concurrently, so that oral health can be well managed and kept clean.

According to the present invention, the index finger is inserted into the cleaning brush and the cleanser is supplied at a water pressure to a portion or desired portion exposed to a brush part made of a soft material so that oral cleaning, that is, cleaning of teeth and gums in the oral cavity may be correctly, speedily and easily performed at water pressure.

DESCRIPTION OF DRAWINGS

FIG. 1 is a perspective view illustrating a preferred embodiment of the present invention.

FIG. 2 is a front view illustrating a state wherein the brush of the present invention is put on a finger.

FIG. 3 is an exploded perspective view illustrating a state wherein the hose of the present invention is disconnected.

FIG. 4 is a front view illustrating an installation state of the present invention.

FIG. 5 is a front cross-sectional view illustrating the installation state of the present invention.

FIG. 6 is a cross-sectional view taken along line A-A in FIG. 5 of the present invention.

FIG. 7 is a cross-sectional view taken along line B-B in FIG. 5 of the present invention.

FIG. 8 is a side cross-sectional view illustrating another embodiment of the feed hole according to the present invention.

FIG. 9 is a side cross-sectional view illustrating another embodiment of the brush according to the present invention.

FIG. 10 is a front view illustrating an embodiment of the concentrated cleanser feeder according to the present invention.

FIG. 11 is a cross-sectional view illustrating another embodiment of the concentrated cleanser feeder according to the present invention.

BEST MODE

Hereinafter, preferred embodiments of the present invention will be described in more detail with reference to the accompanying drawings.

FIG. 1 is a perspective view illustrating a preferred embodiment of the present invention, and FIG. 2 is a front view illustrating a state wherein the brush of the present invention is put on a finger.

An oral cleaner 30 may include: a cleaning tank 34 having a lid 35 provided on top of a body 31 to store a cleaning liquid ("cleanser"); and the body 31 which includes a control unit 32 provided with a pump on the bottom of the tank 34 to spray the cleanser and a space part 33 formed on a portion of the body 31 to accommodate a feed duct 36 and a typical cleaner (not shown) therein.

A cleaning brush 10 connected at a front end of the feed duct 36 through a connector 20 to supply the cleanser, may be put on the index finger 51 of a hand 50. Further, a wrist band 52 is wound around the wrist of a user and fixed thereto with a fastening member 53.

FIG. 3 is an exploded perspective view illustrating a state wherein the hose of the present invention is disconnected, FIG. 4 is a front view illustrating an installation state of the present invention, FIG. 5 is a front cross-sectional view illustrating the installation state of the present invention, FIG. 6 is a cross-sectional view taken along the line A-A in FIG. 5 of the present invention, and FIG. 7 is a cross-sectional view taken along the line B-B in FIG. 5 of the present invention.

The feed duct 36 to supply the cleanser may be assembled to a connector joint 21 of the connector 20, while another connector joint 22 protrudes from the opposite side of the connector joint 21 and is assembled to a coupler 13, whereby this feed duct 36 can be assembled and used only when required.

The cleaning brush 10 includes a finger cover 11 having an insertion space 12 formed in a circular shape to be put on the index finger 51, wherein the finger cover 11 is made of a soft material which is harmless to the human body such as silicone and polypropylene (PP), and is preferably put on about two nodes of the index finger 51.

It is preferable that a feed hole 14 is formed at an upper side of the finger cover 11 and thus is coupled thereto to have a roly-poly toy shape along with the finger cover, and may further include a coupler 13 protruding from the outside of the feed hole 14.

A nozzle member 15 may be provided in a flat shape having a small height and a wide width inside the feed hole 14, while a brush 17 having a predetermined area protrudes on top of the nozzle member 15, wherein a plurality of nozzles 16 for discharging the cleanser from the nozzle member 15 in the protruding direction of the brush 17 is arranged at regular intervals.

The brush 17 may be integrally formed using the same material as the finger cover 11, or may be molded separately using other materials and then combined and used with the finger cover.

FIG. 8 is a side cross-sectional view illustrating another embodiment of the feed hole according to the present invention. In this regard, the feed hole 14 provided above an insertion space 12 in the finger cover 11 may protrude from the upper side of the finger cover to have a roly-poly toy shape along with the finger cover, or may be formed on the upper side of an inner portion formed in a circular shape as a whole.

FIG. 9 is a side cross-sectional view illustrating another embodiment of the brush according to the present invention. In this regard, the brush 17 is provided on top of the finger cover 11 and a side brush 17 protrudes to both sides or either side thereof, wherein the side brush 17 may protrude in a vertical direction or may be inclined in either direction.

FIG. 10 is a front view illustrating an embodiment of the concentrated cleanser feeder according to the present invention, and FIG. 11 is a cross-sectional view illustrating another embodiment of the concentrated cleanser feeder according to the present invention.

A lower coupler 24 may further be provided on a portion of the connector 20, followed by connecting the concentrated cleanser feeder 23 thereto, so as to further supply a required liquid agent or the like.

The concentrated cleanser feeder 23 is preferably formed in a cylindrical shape or a balloon shape such as a bag. Further, a coupling protrusion 25 in either analog or digital mode is coupled to the lower coupler 24. In addition, a backflow preventing member 26 may further be provided inside the coupling protrusion 25 and is installed to supply the cleanser while preventing backflow.

The concentrated cleanser feeder 23 may be used simultaneously with the oral cleaner 30, or either one thereof may be selectively used.

Preferred Embodiments of Invention

The oral cleaner 30 used in the present invention with such configurations as described above may be one with specific use or any one of commercially available cleaners. A front end of the feed duct 36 accommodated in the space part 33 may be directly connected to the coupler 13, and a connector 20 may be used between the feed duct 36 and the coupler 13.

When using the connector 20, the feed duct 36 and the coupler 13 may be coupled to both connector joints 21 and 22, respectively, so as to regularly feed the cleanser into the feed hole 14 without being exposed to the outside.

As shown in FIG. 2, with regard to the cleaning brush 10, the insertion space 12 of the finger cover 11 is put on the index finger 51 of a hand 50. If the feed duct 36 is hung down, there is a difficulty in oral cleaning. Therefore, a wrist band 52 may be wound around a wrist of the user to fit the feed duct 36 to the wrist, followed by fixing the same using a hook and loop fastener 53.

The wrist band 52 may be used to fix the feed duct 36 on the wrist without hanging down, so that cleaning may be conveniently performed using the cleaning brush 10.

While putting the cleaning brush 10 on the index finger 51 of the hand 50, the control unit 32 in the oral cleaner 30 is driven to drive a motor pump or the like in the body 31, so as to supply the cleanser stored in the cleaning tank 34 toward the feed duct 36 and to have a predetermined water pressure.

The user inserts the index finger 51 into the oral cavity of a pet, infant, patient, disabled person, etc., and may wash or clean every corner of the oral cavity using the brush 17 depending upon different oral structures of the same.

When cleaning teeth and gums using the brush 17, the cleanser fed into the feed hole 14 may be discharged at a predetermined pressure into the nozzles 16 arranged in the nozzle member 15 at regular intervals toward the brush 17. Therefore, every portion in the oral cavity can be clearly and quickly cleaned using the brush 17 made of a soft material.

The feed hole 14 provided on top of the finger cover 11 may have a roly-poly toy shape along with the insertion space 12 in order to supply the cleanser, wherein a nozzle member part configured to have wide width and low height occupies a small height while uniformly spraying the cleanser from the nozzles 16.

The brush 17 may be regular in height at top end thereof or may have irregular heights in order to clean the teeth and gums.

The feed hole 14 may be provided on an upper side of the insertion space 12 inside a circular finger cover 11, and may be formed in a circular shape. Further, the brush 17 may protrude not only upward but also both sides or either side. In this regard, the brush protrudes to be inclined vertically or in any one direction so that rotating the index finger 51 to orient in a desired direction may be reduced when cleaning by the index finger 51, instead, the cleaning can be evenly performed even when moving the index finger 51 in a straight line.

During cleaning operation, after adding the lower coupler 24 to the connector 20, a coupling protrusion 25 in either analog or digital mode provided on top of the concentrated cleanser feeder 23 in any one of cylindrical and balloon shapes is coupled to the lower coupler 24. Then, the concentrated cleanser (or other liquid preparation) may be supplied through the connector 20 by pressing the same with another finger not inserted in the cleaning brush 10. Further, the backflow preventing member 26 is installed inside the lower coupler 24 to prevent backflow while supplying the cleanser with finger pressing force, thereby achieving additional functionality.

The above description is provided to explain the technical idea of the present invention with reference to exemplary embodiments thereof, however, it is to be understood that diverse modifications or alterations are possible without departing from essential characteristics of the present invention. Accordingly, the embodiments disclosed herein are intended to illustrate the technical idea of the present invention rather than limit the same, and the scope of the present invention is not restricted by these embodiments. Instead, the scope of the present invention to be protected should be construed by the appended claims and all technical ideas within the range of equivalents should be construed as within the scope of the present invention.

Industrial Applicability

According to the oral cleaner of the present invention, a cleanser may be supplied at a predetermined water pressure from the oral cleaner in a state such that a cleaning brush is put on a portion of a finger of a user and a feed duct is fixed to a wrist of the user, and then, teeth and/or gums may be desirably cleaned with the cleaning brush depending upon a structure of the oral cavity of a pet, infant, patient, disabled person, etc., thereby maintaining oral hygiene and healthy life thereof.

The invention claimed is:

1. A cleaning brush attached to an oral cleaner, the oral cleaner comprising a cleaning tank for storage of a cleaning solution, a body provided with a control unit on a bottom of the cleaning tank, and a feed duct accommodated in the body to feed the cleaning solution at a predetermined water pressure and clean an oral cavity, wherein the cleaning brush comprises:

a feed hole, through which the feed duct is connected, formed on top of a finger cover having a finger insertion space; nozzles provided at a predetermined interval on top of a nozzle member to which the feed hole is connected; and a brush protruding upward around the nozzles, wherein the feed hole has a coupler protruding from an outer side of the feed hole, a connector having connector joints and formed on opposite sides thereof is provided such that the connector joints and connect the feed duct and the coupler to supply the cleaning solution, and wherein the connector is further provided with a lower coupler which is connected to a coupling protrusion formed on top of a concentrated cleaning solution feeder, and a backflow preventing member is installed in the coupling protrusion such that the cleaning solution is fed using a finger not connected to the cleaning brush.

2. The cleaning brush according to claim 1, wherein the nozzle member is formed to have a small height and a wide width and supplies the cleaning solution at a predetermined water pressure from a front end of the coupler to the brush through the coupler and the nozzles on top of the nozzle member.

3. The cleaning brush according to claim 1, wherein the feed hole is provided in a circular shape on an upper side of an insertion space in the finger cover.

4. The cleaning brush according to claim 1, wherein the finger cover is further provided with a side brush on opposite sides or either side of the finger cover as well as the brush provided upward on the finger cover.

5. The cleaning brush according to claim 1, wherein:

the feed duct connects the oral cleaner and the cleaning brush to supply the cleaning solution, and the cleaning brush is fixed to a wrist of a user using a hook and loop fastener of a wrist band.

* * * * *